US005578170A

United States Patent [19]

Erikson et al.

[11] Patent Number: 5,578,170

[45] Date of Patent: Nov. 26, 1996

[54] METHOD OF FORMING A TISSUE PAPER WEB

[75] Inventors: Jan A. Erikson; Ingvar B. E. Klerelid; Jan L. Larsson, all of Karlstad, Sweden

[73] Assignee: Valmet-Karlstad AB, Karlstad, Sweden

[21] Appl. No.: 242,254

[22] Filed: May 13, 1994

[30] Foreign Application Priority Data

May 27, 1993 [SE] Sweden ..... 9301824

[51] Int. Cl.[6] ..... D21F 9/02; D21F 1/36

[52] U.S. Cl. ..... 162/203; 162/112; 162/301; 162/209; 162/355

[58] Field of Search ..... 162/203, 207, 162/209, 300, 301, 302, 303, 355, 356, 352, 111, 112

[56] References Cited

U.S. PATENT DOCUMENTS

| | | | |
|---|---|---|---|
| 4,100,018 | 7/1978 | Wahren et al. | 162/203 |
| 4,306,934 | 12/1981 | Seppanen | 162/209 |
| 4,420,370 | 12/1983 | Saad | 162/209 |
| 4,443,298 | 4/1984 | Thorp | 162/252 |
| 4,561,938 | 12/1985 | Kallmes | 162/314 |
| 4,648,943 | 3/1987 | Malashenko et al. | 162/300 |
| 4,687,549 | 8/1987 | Kallmes | 162/352 |
| 4,790,909 | 12/1988 | Harwood | 162/301 |
| 4,960,492 | 10/1990 | Weitzel et al. | 162/301 |
| 5,225,043 | 7/1993 | Braun et al. | 162/301 |
| 5,259,929 | 11/1993 | Bubik et al. | 162/301 |

FOREIGN PATENT DOCUMENTS 1420219 1/1976 United Kingdom .

OTHER PUBLICATIONS

Evans, John C. W., New twin–wire former designed for maximum fines, solids retention, Pulp & Paper, Dec. 1982, p. 58.

Brochure #S–C 88, Valmet Sym–Concept, front cover, pp. 8–9 and back cover.

Leaflet, Valmet Speed–Former HHS, Gap Former For Rebuilds.

Brochure AMBERTEC Beta Formation Tester.

*Primary Examiner*—Donald E. Czaja
*Assistant Examiner*—Jose A. Fortuna
*Attorney, Agent, or Firm*—Bell, Seltzer, Park & Gibson, P.A.

[57] ABSTRACT

A tissue web (W), which has improved formation and improved tensile properties but no appreciable deterioration of retention and layer purity, if applicable, in comparison with tissue webs produced in conventional twin wire tissue formers, may be formed in a roll type twin wire former by draining 90–99%, preferably 98–99%, of all drainable water from the slurry while on the forming roll (1), preferably a suction forming roll, the remaining 1–10%, preferably 1–2%, of the drainable water being sufficient to have a substantial amount of the papermaking fibers free in the slurry during an initial phase of a subsequent step, and, downstream of said forming roll (1), draining said remaining 1–10%, preferably 1–2%, from the slurry while vibrating the slurry sufficiently to create a micro-turbulence causing a small scale agitation of the fibers to prevent them from forming any appreciable fibrous web (W) on the two forming fabrics (3; 4) until the water remaining in the slurry is insufficient for allowing the fibers to substantially change their position relative to one another. The vibration frequency is at least 100 Hz, and the vibrations may be provided by a multiblade hydrofoil (7).

11 Claims, 8 Drawing Sheets

METHOD OF FORMING A TISSUE PAPER WEB

FIELD AND BACKGROUND OF THE INVENTION

The present invention relates to a method of forming a tissue paper web in a twin wire former having a rotatable forming roll, said method including the steps of: injecting a jet consisting essentially of an aqueous slurry of papermaking fibers into a converging forming throat formed between two looped forming fabrics as they first converge to meet on a periphery of the rotatable forming roll and then partially wrap the forming roll periphery; sandwiching the aqueous slurry between the two forming fabrics and draining water from the slurry through at least one of them as they partially wrap the forming roll periphery; continuing the draining, and draining a sufficient proportion of water from the slurry to cause the papermaking fibers to form a fibrous web; running the two forming fabrics with the papermaking fibers sandwiched between them up to and around a section of a second roll; and separating one of the two forming fabrics from the formed fibrous web and the other forming fabric no earlier than on said second roll.

In this context, the term "tissue paper" is intended to include any grade of "soft crepe paper" or other paper for sanitary purposes, whether creped or not when used by a consumer.

Such a method is disclosed in U.S. Pat. No. 4,100,018 (Wahren et al.), for example, and is the method inherently used for forming a tissue paper web in a PERIFORMER®-LW forming section of S-wrap configuration. Due to the rapid drainage of water from the slurry in high speed twin wire formers for tissue making (about 1800 to 2000 meters per minute or higher with a PERIFORMER®-LW forming section of C-wrap configuration), there is almost no time at all for the papermaking fibers to rearrange themselves or for the paper producer to exert an influence on the formation of the web, that is the manner in which the fibers are distributed, arranged and mixed in the structure of the web. Thus, the formation of a web produced in a twin wire former could be characterized as "frozen" and reflects the relative positions of the fibers in the stock just before the drainage starts. Any disturbance or imperfection at this point will inevitably be found in the web formed on the draining of the slurry. An excellent distribution of the fibers in the slurry will result in an excellent formation, while a less perfect fiber distribution also will result in a less perfect formation and may appear as pin holes or streaking, for example.

In twin wire formers for the production of newsprint and other printing paper grades, such as SPEED-FORMER HS by Valmet Paper Machinery Inc., and the one for the production of lightweight coated grades of paper (LWC) disclosed in U.S. Pat. No. 4,790,909 (Harwood), the speeds used are much lower, about 1300 to 1500 meters per minute and about 900 to 1050 meters per minute, respectively. In these cases the web produced should have as close to one-sided surface properties as possible, that is a minimum of two-sidedness, and the retention of fines and fillers in the surfaces of the web should be comparable to that obtained in a fourdrinier former.

PULP AND PAPER, December 1982, J. C. W. EVANS "New twin wire former designed for maximum fines, solids retention" page 58 discloses a modified new design of the Bel Baie II twin wire former. The new former, called Bel Baie III, is reported to be designed to retain the formation of the Bel Baie II and offer improved solids retention. It is also reported that the Bel Baie II design, which incidentally is disclosed in more detail in United Kingdom Patent No. 1,420,219, for example, is still recommended for all papermaking operations other than those using a high-fines furnish, or for tissue-making where the twin wire tissue former is preferred.

SUMMARY OF THE INVENTION

The main object of the present invention is to provide a method of forming a tissue web having improved formation and improved tensile properties without any appreciable deterioration of retention in comparison to tissue webs produced in conventional twin wire tissue formers.

According to the present invention this object is achieved, in a method of the kind initially stated, by draining substantially all drainable water from the slurry while in a zone curving along the periphery of the forming roll up to where the two forming fabrics run off from the forming roll periphery, but leaving a sufficient proportion of drainable water to have a substantial amount of the papermaking fibers free in the slurry during an initial phase of a subsequent step, and draining, downstream of said zone, the left proportion of drainable water from the slurry while vibrating the slurry sufficiently to create a micro-turbulence causing a small scale agitation of the fibers to prevent them from forming any appreciable fibrous web until the water remaining in the slurry is insufficient for allowing the fibers to substantially change their position relative to one another.

In this context, the term "drainable water" is intended to mean the water that can be drained from the sandwiched slurry in the twin wire former by the use of conventional web forming technology. Even when all drainable water has been drained off, the newly formed paper web on leaving the web former may still have a moisture content of 85%, for example.

By draining all of the drainable water at the forming roll, with the exception of a minor fraction left to permit a substantial amount of the fibers to be free to move on a small scale in the slurry and rearrange themselves under exposure to the vibrations, web formation is improved and, surprisingly, retention is comparable to the one obtained in a conventional twin wire roll former instead of deteriorating due to the vibrations, as is the case in twin wire blade formers for the production of newsprint and other printing paper grades.

Preferably, the micro-turbulence is achieved by vibrating the slurry with a frequency of at least 100 Hz. While the exact mechanism at the final stage of the web forming and sheet setting under influence of micro-turbulence is unknown, it seems that under these circumstances the papermaking fibers in the slurry have no time to build an embryonic web on each of the two forming fabrics, and—at least in theory—it should be possible to achieve a total sheet set with the best possible formation by completing the draining of the slurry while the fibers are kept constantly agitated until there is not sufficient water left to permit agitation.

In order to obtain vibrations of a small amplitude for creating the micro-turbulence, we prefer to provide a multi-blade hydrofoil at a location downstream of the forming roll but upstream of the second roll. The hydrofoil has a plurality of equidistantly spaced foil blades of equal size, suitably at least four foil blades disposed on a center to center spacing on the order of 50 to 330 millimeters (2 to 13 inches), for contacting a contiguous one of the forming fabrics, and defines a substantially convexly curved surface supporting said one forming fabric.

Below, we will term a twin wire former, in which a predraining of the stock is carried out on a forming roll and the subsequent drainage necessary to form and "set the web" is carried out on a series of blades downstream of the forming roll, a "roll-and-blade" former as distinguished from a "blade-and-roll" former, for example, where the predraining takes place when the stock sandwiched between the forming fabrics passes over a series of blades and where the subsequent drainage necessary to form and set the web takes place on a forming roll downstream of the blades. Especially with low consistency stocks for tissue making, the blades of a blade-and-roll former will shake out a considerable amount of fibers and fines and fillers through the forming fabrics. In analogy with the above definition, the Bel Baie II former referred to above and having no forming roll is to be termed a pure "blade" former.

Although the installation of a multiblade hydrofoil in accordance with the present invention may be applied in various configurations of twin wire tissue formers, we prefer starting from a twin wire former of basically C-wrap type and disposing the multiblade hydrofoil within the loop of the forming fabric that constitutes an outer forming fabric relative to the forming roll and the other forming fabric, while the second roll being disposed within the loop of the inner forming fabric.

It is also preferred to provide as forming roll a suction forming roll, and to drain the slurry through both of the forming fabrics in the zone where they wrap the forming roll. In comparison with a plain-surfaced forming roll, a suction forming roll will contribute to improved formation at medium and high basis weights. This effect is more pronounced with recycled fibers and also with increasing basis weight. The wrap angle of the outer forming fabric on the suction forming roll suitably is on the order of 15° to 45°, while on a plain-surfaced forming roll it would be on the order of 45° to 135°.

In order to have an optimum amount (suitably from about 1% to about 10%, preferably about 1% to about 2%) of drainable water left in the slurry when the partially drained slurry sandwiched between the two forming fabrics arrives at the multiblade hydrofoil, we prefer to provide a headbox for discharging the slurry into the forming throat, provide a breast roll for the outer forming fabric immediately upstream of the forming throat, and swing the headbox and the breast roll as one assembly around a rotational axis of the forming roll to adjust the degree of wrap of the outer forming fabric on the forming roll, and thereby also adjust the proportion of drainable water drained from the slurry at the forming roll.

DETAILED DESCRIPTION OF THE MOST PREFERRED EMBODIMENT

Figure 1:
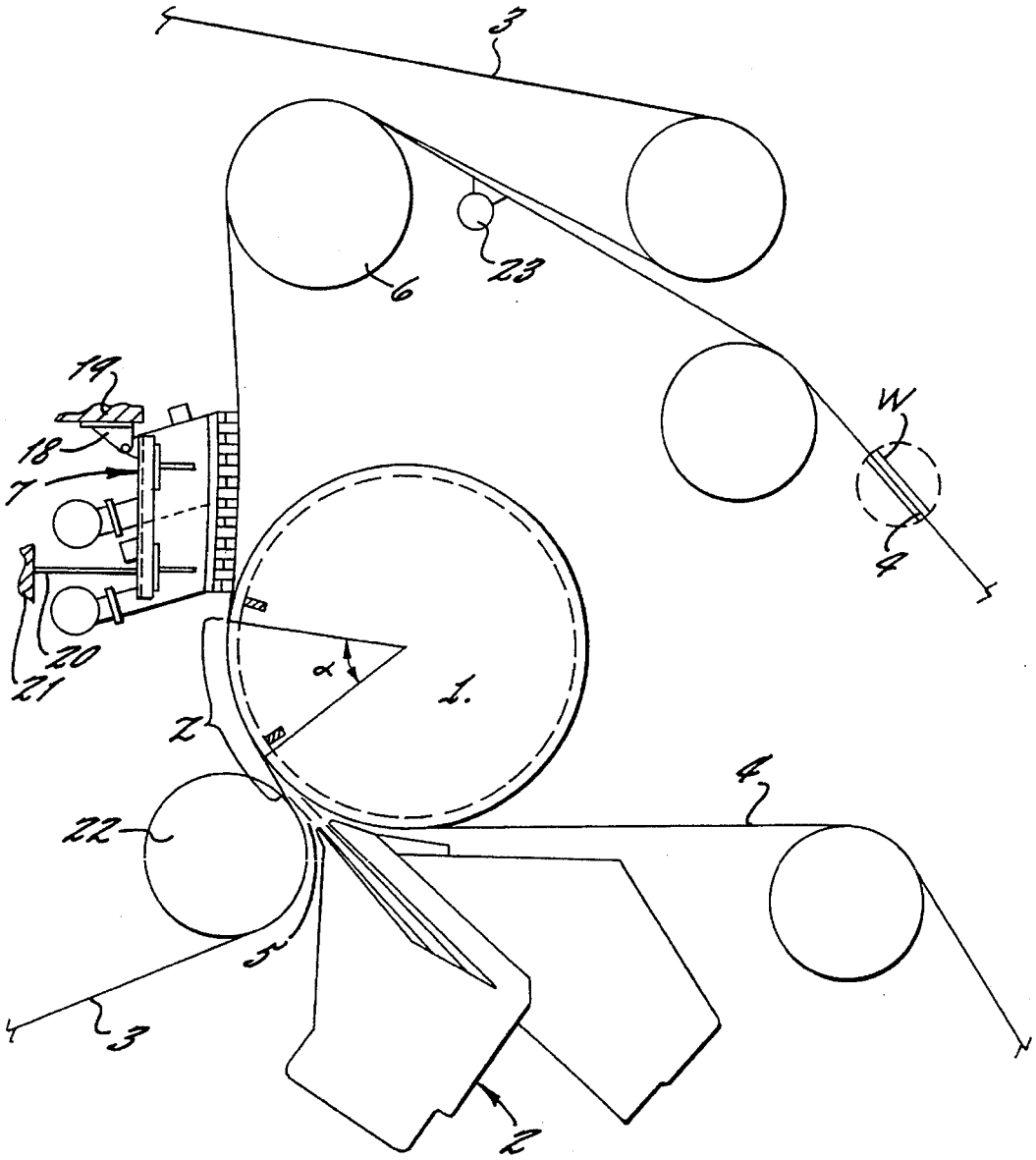
FIG. 1 is a schematic side elevational view of a roll type twin wire tissue former modified into a roll-and-blade former by the installation of a multiblade hydrofoil in accordance with one embodiment of the present invention.

Basically, the former illustrated in FIG. 1 is a conventional roll type twin wire tissue former that has been modified in some respects in view of the method steps carried out, in accordance with the present invention, for forming a tissue paper web W in a twin wire former having a rotatable forming roll 1. A known method of forming a tissue paper web in a conventional roll type twin wire tissue former includes the following steps:

a) Injecting from a headbox 2 a jet consisting essentially of an aqueous slurry of papermaking fibers in water into a converging forming throat 5 formed between two looped forming fabrics 3 and 4 as they first converge to meet on a periphery of the rotatable forming roll 1 and then partially wrap the forming roll periphery. Fabric 3 constitutes an outer forming fabric in relation to fabric 4 in a zone where the fabrics partially wrap a portion of the forming roll periphery, and forming roll 1 is located inside the loop of the inner forming fabric 4. The illustrated headbox 2 is a multilayer headbox for discharging a multilayered jet of stock into the forming throat 5, more precisely a three-layer headbox, but it might as well be a two-layer headbox or a single-layer headbox.

b) Sandwiching the aqueous slurry between the two forming fabrics 3 and 4, and draining water from the slurry through at least one of them as they partially wrap the forming roll periphery.

c) Continuing the draining, and draining a sufficient proportion of water from the slurry to cause the papermaking fibers to form a fibrous web W.

d) Running the two forming fabrics 3 and 4 with the papermaking fibers sandwiched between them up to and around a section of a second roll 6.

e) Separating one of the two forming fabrics 3 and 4 from the formed fibrous web W and the other forming fabric no earlier than on said second roll 6.

In order to provide a method of forming a tissue web having improved formation and improved tensile properties without any appreciable deterioration of retention and layer purity, if applicable, in comparison to tissue webs produced in conventional twin wire tissue formers, the known method above is supplemented with the following steps in accordance with the present invention:

f) Draining substantially all drainable water from the slurry while in a zone Z curving along the periphery of the forming roll 1 up to where the two forming fabrics 3 and 4 run off from the forming roll periphery, but leaving a sufficient proportion of drainable water to have a substantial amount of the papermaking fibers free in the slurry during an initial phase of step g); and g) Draining, downstream of said zone Z, the left proportion of drainable water from the slurry while vibrating the slurry sufficiently to create a micro-turbulence causing a small scale agitation of the fibers to prevent them from forming any appreciable fibrous web until the water remaining in the slurry is insufficient for allowing the fibers to substantially change their position relative to one another.

Preferably, the micro-turbulence is achieved by vibrating the slurry with a frequency of at least 100 Hz. Then, the papermaking fibers in the slurry are believed to have no time to build an embryonic web on each of the two forming fabrics, and—at least in theory—it should be possible to achieve a total sheet set with the best possible formation by completing the draining of the slurry while the fibers are kept constantly agitated until there is not sufficient water left to permit agitation.

In order to obtain vibrations of a small amplitude for creating the micro-turbulence, we prefer to provide a multiblade hydrofoil 7 at a location downstream of the forming roll 1 but upstream of the second roll 6 as shown in the embodiment illustrated in FIG. 1. There the hydrofoil 7 is located inside the loop of the forming fabric that constitutes the outer forming fabric 3 in relation to the forming roll 1 and the other forming fabric 4 in the twin wire former, while the second roll 6 is located inside the loop of the inner forming fabric 4. The hydrofoil 7, which is shown on a greater scale in FIG. 2, has a plurality of elongate equidistantly spaced wear-resistant foil elements 8, which are arranged in a side by side relationship and extend over the width of the forming fabrics 3 and 4. Suitably there are at least four foil elements 8 of equal size disposed on a center to center spacing on the order of 50 to 330 millimeters (2 to 13 inches), for contacting a contiguous one 3 of the forming fabrics 3 and 4, and they are located so as to define a substantially convexly curved surface supporting said one forming fabric 3. In view of everyday language, the foil elements 8 henceforth will be referred to as foil blades irrespective of their actual shape, which may be similar to a substantially square rod, for example.

Figure 2:
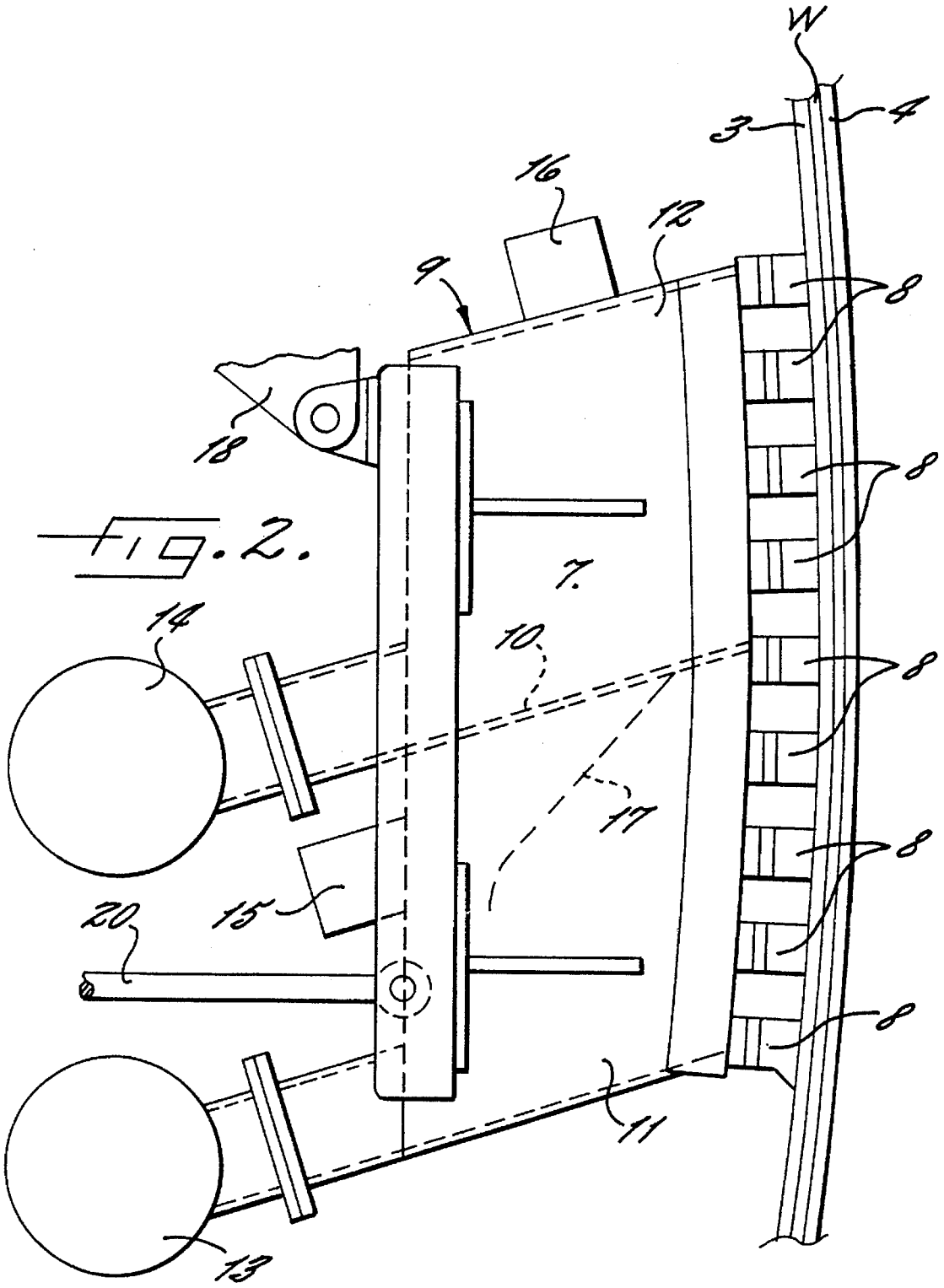
FIG. 2 is an enlarged scale side elevational view of the multiblade hydrofoil shown in FIG. 1.

In the preferred embodiment illustrated most clearly in FIG. 2, the hydrofoil 7 has nine foil blades 8 mounted on a box-shaped carrier 9 to form the convexly curved support surface, which may have a radius of curvature on the order of 5 meters. The shown foil blades 8 are of a basically rectangular cross sectional shape and have a width on the order of 50 millimeters (2 inches) with the exception of the leading foil blade, which is extended on its leading side to form an edge defined by a top surface and a leading lateral surface of the foil blade and enclosing an edge angle on the order of 45°. The leading as well as the trailing lateral surfaces of the other foil blades have top portions sloping inward at angles on the order of 15°, so that the formed enclosed edge angle will be on the order of 75°, and so that said other foil blades will be symmetrical. All of the foil blades 8 have a top surface that forms a part of the curved fabric supporting surface. This top surface is provided with a longitudinally extending crest located about 25 millimeters (1 inch) from the trailing edge of the foil blade, and from this crest both the leading and the trailing portions of the top surface slope downwards at a small angle, preferably on the order of 0.25°.

By means of a partition 10 the carrier 9 for the foil blades 8 is divided into a leading compartment 11 and a trailing compartment 12, both of which are provided with outlets 13 and 14, respectively, for water drained from the sandwiched slurry at the end of the web forming step. Both of the compartments are also provided with stub pipes 15 and 16, respectively, for connection over suitable pressure controlling means, not shown, to a vacuum system, also not shown, for assisting in the draining. Stub pipe 16 is mounted in a top wall of trailing compartment 12 out of reach for possible splashes of drained water, while stub pipe 1B is mounted in a rear wall of leading compartment 11 and is protected from splashing water by a shield plate 17 interposed between the stub pipe and the foil blades. Alternatively, the vacuum system is provided with a water separator, not shown, and is connected to the outlets 13 and 14. At its top, the carrier 9 is pivotally hinged in two brackets 18, one of which is shown in FIG. 1, and the brackets are adjustably mounted to a frame member 19 of a framework for the twin wire former. Spaced from the two brackets 18 there are provided two carrier position adjusting means, one of which is shown as a rod 20 having one end pivotally connected to the carrier 9 and the other end adjustably connected to another frame member 21 of the framework.

In the preferred embodiment illustrated in FIG. 1, the forming roll is a suction forming roll 1, and a breast roll 22 for the outer forming fabric 3 is located inside the forming fabric loop in such a position in relation to the forming roll 1 and the multiblade hydrofoil 7 that the outer forming fabric 3 will wrap the periphery of the suction forming roll 1 over an angle $\alpha$ on the order of 15° to 45°. While a plain-surfaced forming roll may be used, it is less preferred and it would require a wrap angle $\alpha$ on the order of 45° to 135°. Irrespective of what type of forming roll is being used, in cases where a broad range of basis weights is to be produced on the roll-and-blade former according to the invention it may be advantageous to design the former so as to permit a swinging of the headbox 2 and the breast roll 22 as one assembly around a rotational axis of the forming roll 1. Thereby it will be possible to adjust the degree of wrap (angle $\alpha$) of the outer forming fabric 3 on the forming roll 1 and, consequently, also control the proportion of drainable water drained from the slurry at the forming roll 1. Suitably, from about 90% to about 99%, preferably about 98% to about 99%, of the drainable water should be drained from the slurry at the forming roll 1, so that not more than from about 1% to about 10%, preferably about 1% to about 2%, of the drainable water remains in the slurry on its arrival at the multiblade hydrofoil 7. This small remaining amount of drainable water will result in the advantage that there will be no deterioration in retention and/or in layer purity, yet it will facilitate the achievement of a sudden "total sheet set" (i.e. in principle no formation of embryonic webs on the forming fabrics 3 and 4 with slurry of a lower consistency sandwiched between them), which we believe requires a continuous small scale agitation of the fibers, until the water remaining in the slurry is insufficient for allowing the fibers to substantially change their position relative to one another.

After the forming of the web W at the multiblade hydrofoil 7 the web runs sandwiched between the two forming fabrics up to and around the second roll 6. This roll is shown as being a plain-surfaced roll but, if desired, it might as well be a suction roll to assist in the removal of water from the web W. In the embodiment illustrated in FIG. 1, a plain surface on the second roll 6 gives the advantageous "table roll effect", which will assist in adhering the web W to the inner forming fabric 4 when the outer forming fabric 3 on leaving the second roll 6 is deflected a small angle from the inner forming fabric 4 and the web W carried thereby. To ensure the desired transfer of the web W to the inner forming fabric 4, a transfer suction box 23 may be provided downstream of the second roll 6 inside the inner forming fabric loop.

In order not to unnecessarily crowd the drawings, some apparatus, which constitutes no part of the present invention but is necessary or advantageous for running a twin wire former, is not disclosed. As an example, there is a first save-all, not shown, located between breast roll 22 and hydrofoil 7 for collecting white water drained through the outer forming fabric 3 in zone Z and thrown outward from the forming roll 1. Further, on the opposite side of the inner forming fabric 4 there is a white water deflector, not shown, mounted in a closely spaced relationship to the inner forming fabric 4 immediately downstream of the point where the forming fabrics run away from the forming roll 1. The deflector is provided with a curved extension extending over the top of the forming roll 1 to a second save-all, not shown, located on the right-hand side of forming roll 1 in FIG. 1 for collecting white water that has passed through the inner forming fabric 4 into the suction forming roll 1, where it has been temporarily stored until the forming fabrics leave the suction zone.

FIGS. 3 to 10 illustrate the improvement in some relevant properties of a tissue paper web formed in accordance with the present invention. In FIGS. 3 to 9 open square dots (□) represent measured values relating to tissue webs formed in a roll-and-blade twin wire tissue former of the kind shown in FIG. 1, while solid square dots (■) and solid delta dots (▲) represent measured values relating to webs formed in a conventional C-wrap twin wire tissue former having a suction forming roll and a plain-surfaced forming roll, respectively.

Figure 3:
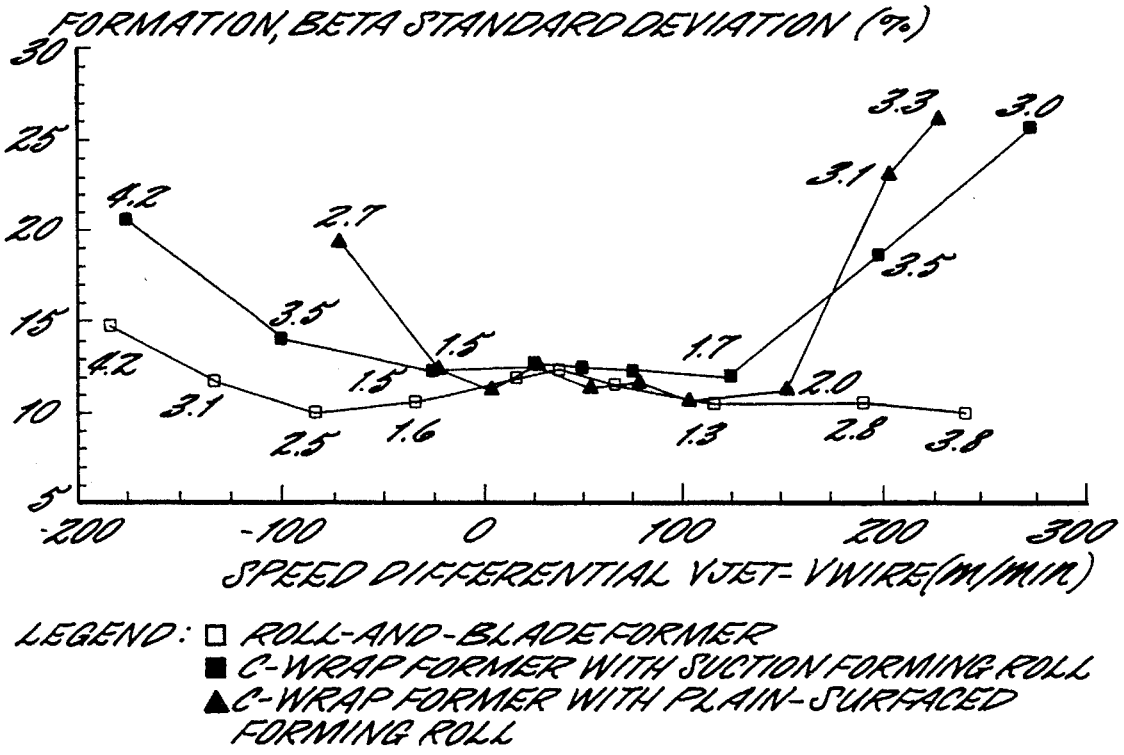
FIG. 3 is a graph illustrating the improvement in formation of virgin fiber webs produced at various speed differentials in the roll-and-blade former of FIG. 1 over those produced under similar conditions in two prior art C-wrap formers having an open-surfaced forming roll and a plain-surfaced one, respectively.
Figure 4:
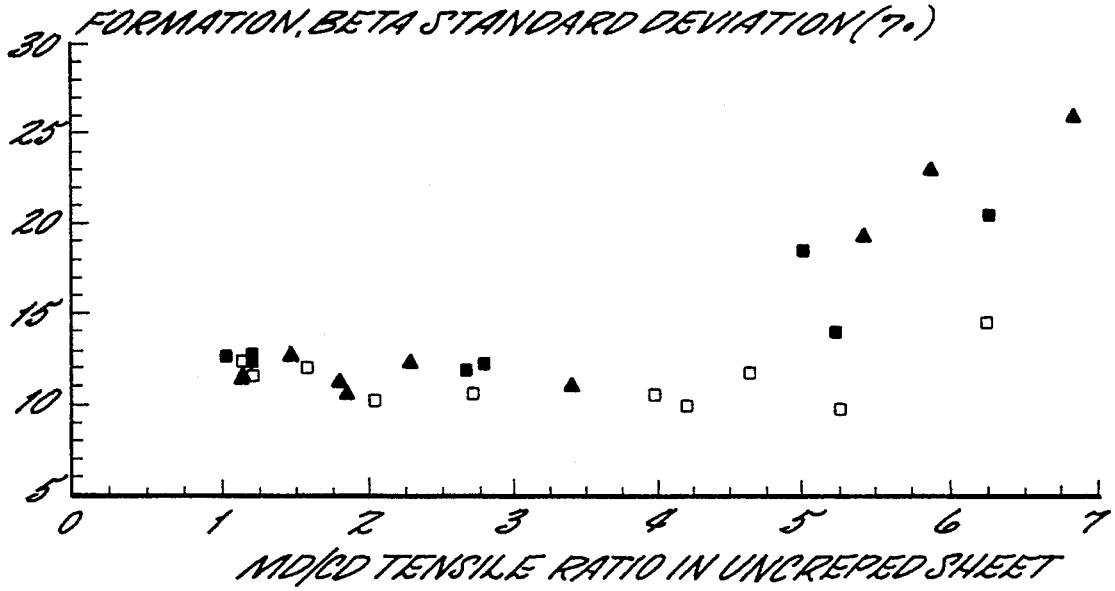
FIG. 4 is a graph illustrating the improvement in formation as a function of MD/CD tensile ratio in virgin fiber uncreped webs produced in the roll-and-blade former of FIG. 1 over those produced under similar conditions in two prior art C-wrap formers having an open-surfaced forming roll and a plain-surfaced one, respectively.

The difference between the speed ($V_{jet}$) of the stock jet ejected from the headbox 2 and the speed ($V_{wire}$) of the forming fabrics 3 and 4 affects the formation of the web W. FIGS. 3 and 4 are graphs illustrating the variations in "beta formation" with varying speed differentials and varying MD/CD tensile ratios, respectively, and all beta formation values that we refer to are measured on uncreped web samples.

The term "beta formation" means standard deviation in basis weight as measured by beta radiation. Consequently, a low beta formation value is better than a high one. A suitable instrument for measuring beta formation is the AMBERTEC Beta Formation Tester available from Ambertec Oy, Espoo, Finland.

The term "MD/CD tensile ratio" means the tensile strength of a web in its length direction (i. e. the machine direction) divided by that in the cross direction of the web. The tensile strength tests were carried out in accordance with standardized test procedure TAPPI T-494 (SCAN-P 44:81).

In FIG. 3 most of the dots are provided with a two-digit decimal number indicating the MD/CD tensile ratio of a test web of a specified beta formation and produced at a specified speed differential in a roll-and-blade former, a C-wrap former having a suction forming roll, and a C-wrap former having a plain-surfaced forming roll. The test values in FIG. 4 relate to uncreped webs, while the MD/CD values in FIG. 3 relate to creped webs. In other respects the webs having the test results illustrated in FIGS. 3 and 4 are identical and consist essentially of virgin fibers and have a basis weight of 20 gsm (g/m$^2$). All basis weights that we refer to are measured on uncreped web samples, and the virgin fibers were 50% Scandinavian softwood and 50% eucalyptus, and the webs were prepared from a stock having a freeness value of about 600 CSF. Freeness value, or CSF-number (Canadian Standard Freeness), is a measure of the drainability of the stock and is determined according to standardized test procedures, e.g. TAPPI T-227 (SCAN-C 21 or SCAN-M 4).

Figure 5:
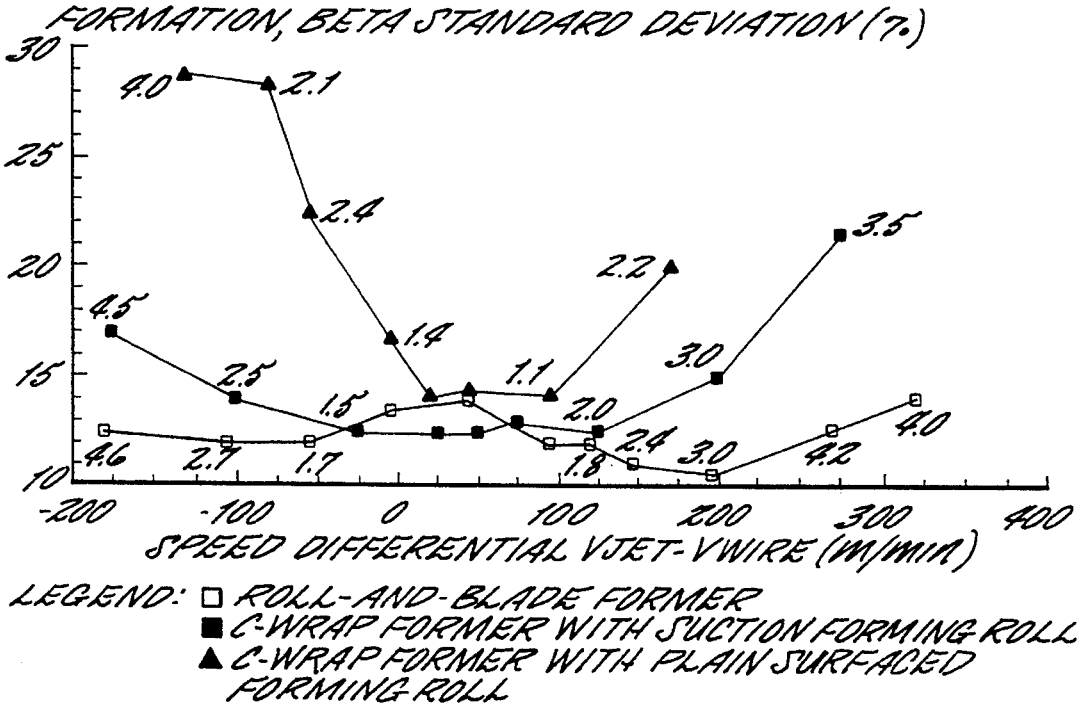
FIGS. 5 and 6 are graphs similar to FIGS. 3 and 4, respectively, but with recycled fibers substituted for the virgin fibers.
Figure 6:
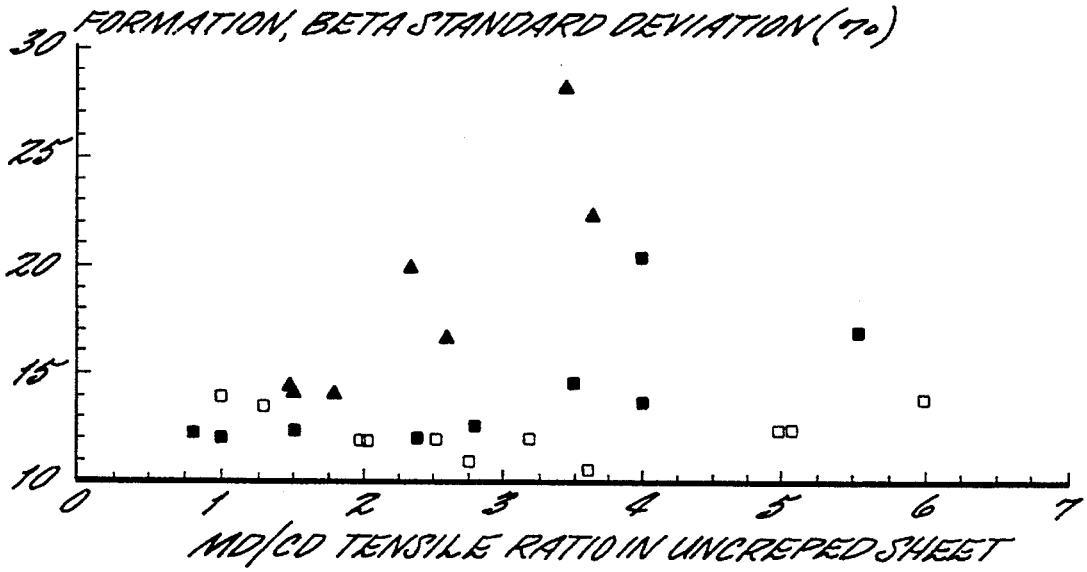

The webs, on which the test results illustrated in FIGS. 5 and 6 are based, differ from those in FIGS. 3 and 4 only in consisting essentially of recycled fibers from computer print-out. The stock of recycled fibers had a freeness value of about 250 CSF.

FIGS. 3 to 6 clearly show that in comparison with tissue webs formed in conventional twin wire roll type formers, where as a rule a not very satisfactory formation has to be accepted in case high MD/CD tensile ratios are desired, webs formed in accordance with the present invention maintain a very satisfactory formation even at high tensile ratios. As illustrated in FIGS. 3 and 5, the beta formation of a web formed on the roll-and-blade former, as contrasted to that of a web formed in a C-wrap type former having a suction forming roll or a plain-surfaced forming roll, is substantially constant at speed differentials ($V_{jet}$–$V_{wire}$) on the order of from about −200 meters per minute to about +250 meters per minute. The possibility of forming tissue webs that in addition to very satisfactory formation have high MD/CD tensile ratios, i.e. tensile ratios in the range of 2–5, is of great interest in manufacturing a majority of various tissue products, and the utilization of speed differentials is the prevailing method of obtaining high MD/CD tensile ratios. A comparison of FIGS. 3 and 4 with FIGS. 5 and 6 clearly indicates that in case the webs are formed from recycled fibers instead of virgin fibers the advantages of the present invention over prior art methods are still more pronounced. Consequently, the method of the present invention may also be characterized as being very insensitive to changes in freeness value.

Figure 7:
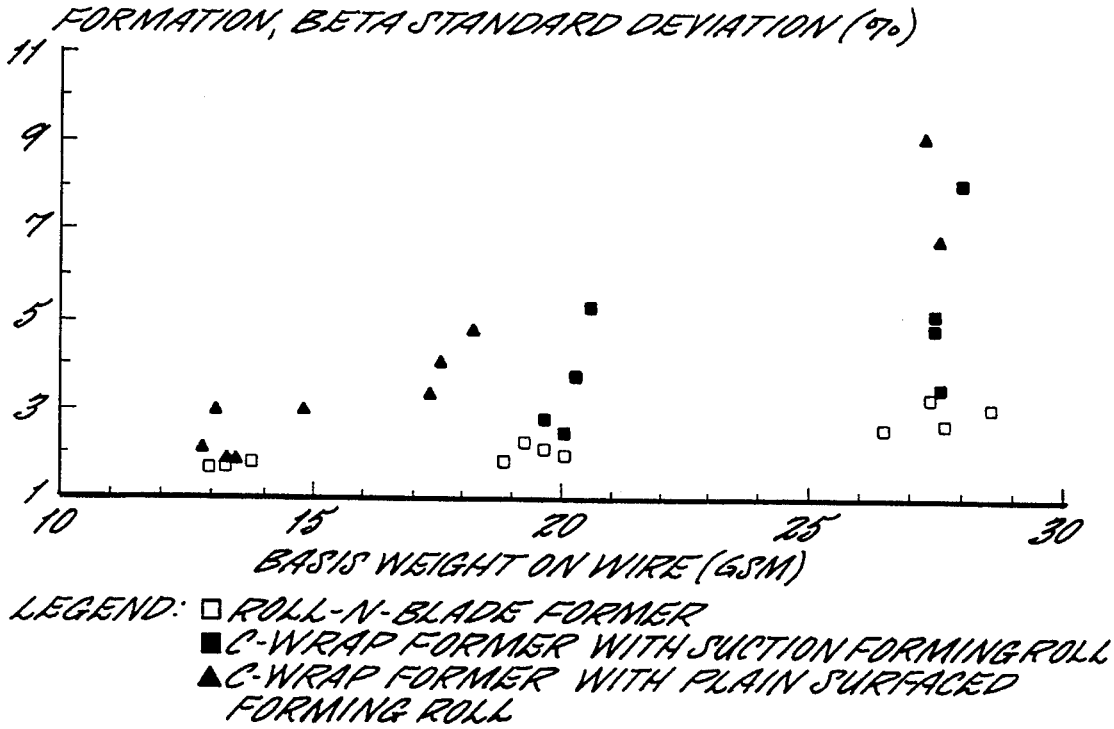
FIG. 7 is a graph illustrating the improvement in formation as a function of basis weight of virgin fiber uncreped webs produced in the roll-and-blade former of FIG. 1 over those produced under similar conditions in two prior art C-wrap formers having an open-surfaced forming roll and a plain-surfaced one, respectively.

FIG. 7 is a graph illustrating the slight increase in beta formation with increasing basis weight of a web formed on the roll-and-blade former, as contrasted to that of a web formed in a C-wrap type former having a suction forming roll or a plain-surfaced forming roll. As pointed out above, beta formation is the standard deviation in basis weight, and a low value is better than a high one. The beta formation was measured on uncreped webs having an MD/CD tensile ratio of 2 to 4 after creping and consisting essentially of virgin fibers. Even at a basis weight of about 28 gsm (g/m$^2$), a web formed in accordance with the present invention on a roll-and-blade former has a beta formation that is better than that of a web of a basis weight of about 20 gsm (g/m$^2$)

formed on a conventional C-wrap former having a suction forming roll. As is obvious from FIG. 7, the method according to the present invention is advantageous over large basis weight range.

Figure 8:
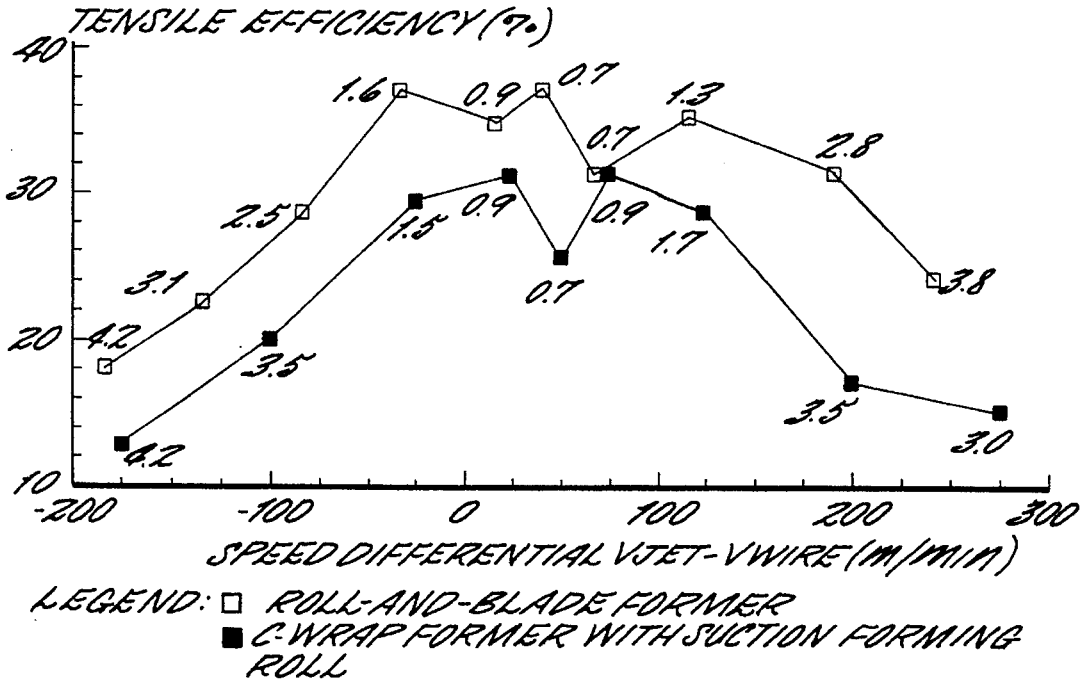
FIG. 8 is a graph illustrating the improvement in tensile efficiency of virgin fiber creped webs produced at various speed differentials in the roll-and-blade former of FIG. 1 over those produced under similar conditions in a prior art C-wrap former having an open-surfaced forming roll.
Figure 9:
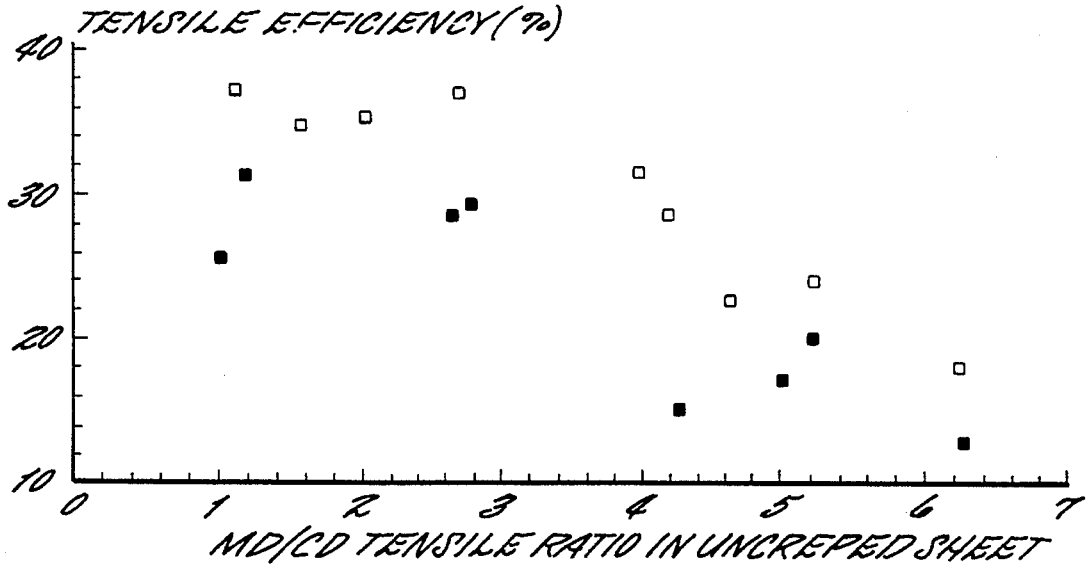
FIG. 9 is a graph illustrating the improvement in tensile efficiency as a function of MD/CD tensile ratio in virgin fiber uncreped webs produced in the roll-and-blade former of FIG. 1 over those produced under similar conditions in a prior art C-wrap former having an open-surfaced forming roll.

FIGS. 8 and 9 are graphs illustrating the variations in tensile efficiency with varying speed differentials and varying MD/CD tensile ratios, respectively. The term "tensile efficiency" means the "tensile index" of the web sample expressed as a percentage of that of a laboratory sheet prepared from machine chest stock in accordance with standardized test procedure TAPPI T-205 (SCAN-C 26:76 or SCAN-M 5:76), and the process for determining the tensile index is described in TAPPI T-220 (SCAN-C 28:76 or SCAN-M 8:76). The test results illustrated in FIGS. 8 and 9 relate to samples of tissue webs consisting essentially of virgin fibers and having a basis weight of 20 gsm (g/m$^2$), and the tensile efficiency values are measured on uncreped web samples. Also in this case the open square dots represent measured values relating to tissue webs formed in a roll-and-blade twin wire tissue former of the kind shown in FIG. 1, while the solid square dots represent measured values relating to webs formed in a conventional C-wrap twin wire tissue former having a suction forming roll, and the two-digit decimal numbers against the individual dots indicate the MD/CD tensile ratios after creping of the various web samples. As is evident from FIGS. 8 and 9, the improvement in tensile efficiency of webs formed in accordance with the present invention over those formed in a conventional C-wrap twin wire tissue former having a suction forming roll is substantial.

Figure 10:
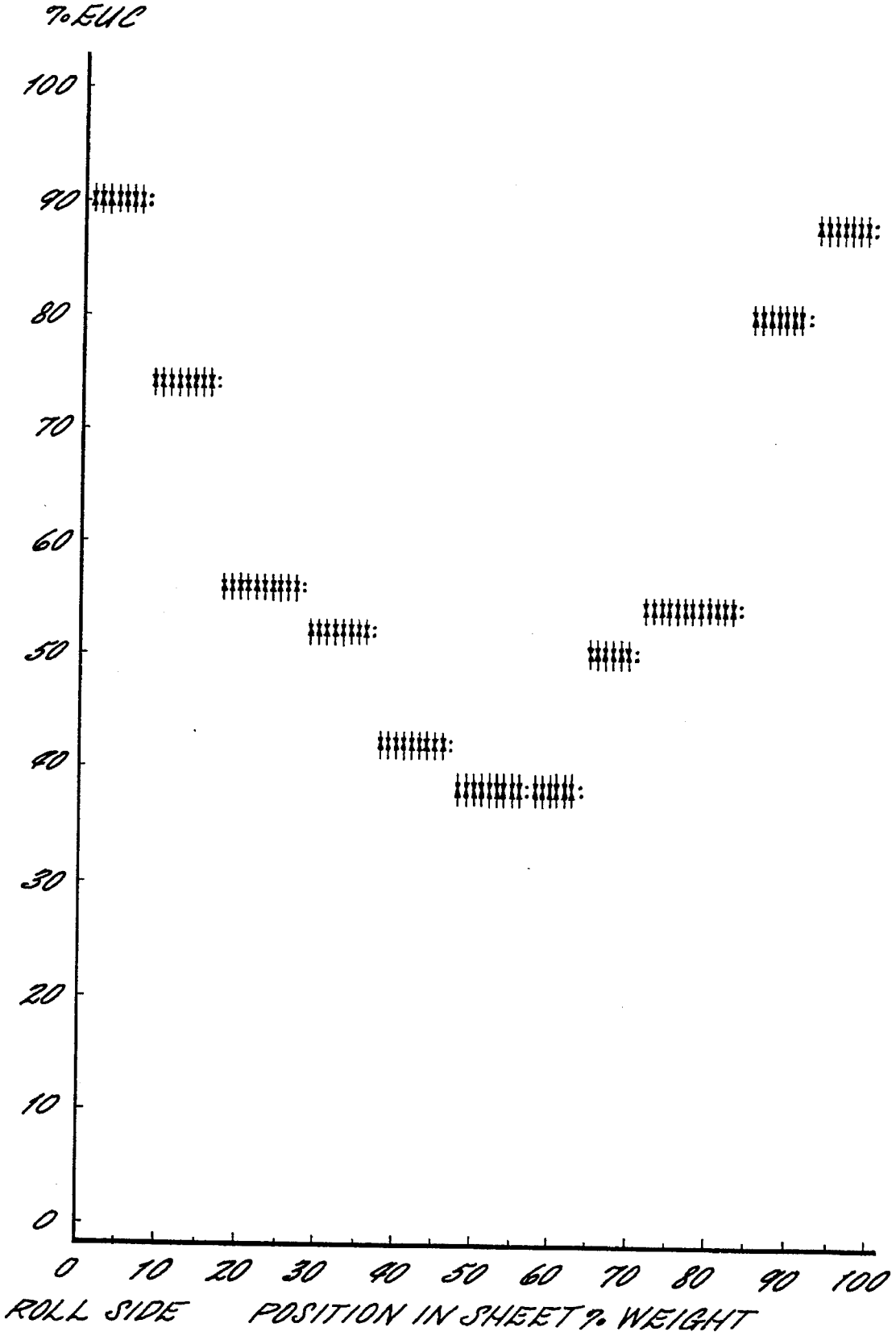
FIG. 10 is a graph illustrating the layer purity in a three-layer web produced in the roll-and-blade former of FIG. 1.

FIG. 10 is a graph illustrating layer purity of a three-layer web having a basis weight of 22.5 gsm (g/m$^2$) and formed in accordance with the present invention. The basis weight split is 30% hardwood, 40% softwood, and 30% hardwood (eucalyptus). Contrary to what could be expected, the layer purity is fully comparable to the one obtained in a conventional twin wire roll type tissue former.

Summarizing the advantages of the forming method according to the present invention we get the following:

Formation

As demonstrated above, an improved formation can be achieved. A good formation is a prerequisite for achieving the desired softness of the web, and for achieving a uniform permeability of the web. A uniform permeability is essential when using through air drying (TAD) technology for drying the web. Further, an improved formation results in an improved runability of the tissue machine, since also the uniformity of the yankee dryer coating will be improved.

Alternatively, the ability of the roll-and-blade former to improve the formation can be utilized to maintain an already satisfactory formation and to start the forming of the web by ejecting a stock jet of a consistency higher than usual from a headbox having a slice opening of reduced gap width. The use of a higher consistency means that less water will have to be drained from the stock to form the web, and less energy for pumping will be required.

Formation/Tensile Ratio

As stated above, the beta formation of a web formed on the roll-and-blade former is substantially constant at speed differentials ($V_{jet}-V_{wire}$) on the order of from about −200 meters per minute to about +250 meters per minute. The utilization of speed differentials is the prevailing method of obtaining high MD/CD tensile ratios. The possibility of forming tissue webs that in addition to very satisfactory formation have high tensile ratios, i.e. tensile ratios in the range of 2–5, is of great interest in manufacturing a majority of various tissue products and is a major advantage of the present invention. On conventional twin wire roll formers the formation starts to deteriorate already at lower tensile ratios, so that it is necessary to accept a less good formation in order to reach the desired high tensile ratios.

Tensile Strength

An improved formation always generates a higher tensile strength. The reason therefor is that the fibers are utilized more efficiently. Higher tensile strength means higher tensile efficiency, which, if desired, can be used for reducing the refining of the pulp or the proportion of long fibers in the stock, and a softer web of higher quality can be achieved. Less refining also means improved draining and drying capacities of the tissue machine.

Basis Weight Range

The method in accordance with the present invention of forming a web on a roll-and-blade former enables a tissue manufacturer to produce high quality tissue paper within a very large range of basis weights. One design of the multi-blade hydrofoil, such as the nine-blade two-compartment hydrofoil illustrated in FIG. 2, is sufficient for permitting the forming of webs having basis weights ranging from about 13 gsm (g/m$^2$) to about 50 gsm (g/m$^2$). Above 50 gsm (g/m$^2$) it is recommendable to add a compartment with additional blades, and with uncreped webs having basis weights lower than about 13 gsm (g/m$^2$) you have the problems of formation of pinholes in the web like in conventional suction roll formers.

The forming method according to the present invention is very insensitive to changes in freeness value. The advantages referred to above are achieved when the papermaking fibers consist essentially of virgin fibers as when they consist essentially of recycled fibers. In fact, the advantages achieved when the webs are formed from recycled fibers appear to be more pronounced than when they are formed from virgin fibers.

Multilayering and Retention

The roll-and-blade former used for carrying out the method in accordance with the present invention unexpectedly generates as good layer purities and retention levels as does the conventional genuine roll former. The reason herefor is that irrespective of the installation of the multi-blade hydrofoil we still drain nearly all of the drainable water on the forming roll. We leave just from about 1% to about 10%, preferably from about 1% to about 2%, of the drainable water to be drained on the multiblade hydrofoil, where the vibration or pressure pulses brought about by the blades causes a small scale agitation of the fibers until the remaining water is insufficient for allowing the fibers to substantially change their position relative to one another. The small amount of water left at the hydrofoil is sufficient for permitting agitation of the fibers to improve the formation, but is too small to let the vibrations or pressure pulses deteriorate the layer purity or shake any appreciable amount of fines and fibers out of the web.

Drainage on blades is known to be detrimental to layer purity and retention, but our using the multiblade hydrofoil almost exclusively as a formation improving element and only to a very minor extent as a draining element is a keystone of the present invention.

Process Optimization and Drainage

The balance between drainage on the forming roll and drainage on the multiblade hydrofoil is set in the first place by the wrap angle α of the outer forming fabric on the forming roll. However, with a suction forming roll it is possible to adjust this balance to some extent by changing the vacuum level in the suction zone of the forming roll. The desired speed, basis weight, and furnish are decisive for an optimum magnitude of the wrap angle, which is set from the beginning, but a fine-tuning of the drainage balance can be carried out by adjusting the vacuum level. An additional adjustment of the drainage balance is possible if the headbox and the breast roll for the outer forming fabric are mounted to be pivotable as one assembly around the rotational axis of the forming roll in order to change the wrap angle. However, as a rule the possibilities of adjusting the drainage balance are sufficient without having to resort to complicated designs. When a suction forming roll is used, the wrap angle is about one third of that required when a plain-surfaced forming roll is used.

Detailed Description of Other Preferred Embodiments

FIGS. 11 to 14 show alternative embodiments of roll-and-blade twin wire tissue formers. However, as these embodiments have much in common with that shown in FIGS. 1 and 2 and described above, the corresponding items in FIGS. 11 to 14 have been given reference numerals in the 100 to 400 series, respectively. e.g. the multiblade hydrofoil, which is denoted by 7 in FIG. 1, is designated 107 in FIG. 11, 207 in FIG. 12, 307 in FIG. 13, and 407 in FIG. 14. Similarly, the headbox that is denoted by 2 in FIG. 1 is designated 102 in FIG. 11, 202 in FIG. 12, 302 in FIG. 13, and 402 in FIG. 14.

Figure 11:
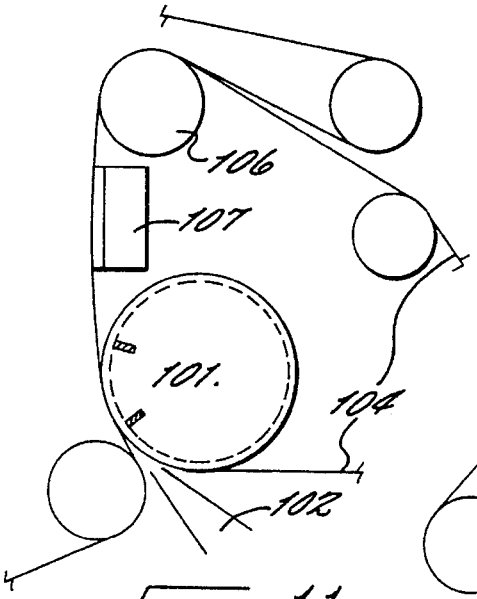
FIGS. 11, 12, 13 and 14 are schematic side elevational views of four additional roll type twin wire tissue formers modified into roll-and-blade formers by the installation of a multiblade hydrofoil in accordance with the present invention.

The embodiment illustrated in FIG. 11 differs from that shown in FIG. 1 only in that the multiblade hydrofoil 107 is positioned on the opposite side of the fabric-web-fabric sandwich and, consequently, is located inside the loop of the inner forming fabric 104 instead of inside the loop of the outer forming fabric. This embodiment gives the same advantages as the one shown in FIG. 1, but may require more space in vertical direction to accommodate the hydrofoil 107 between the forming roll 101 and the second roll 106.

Figure 12:
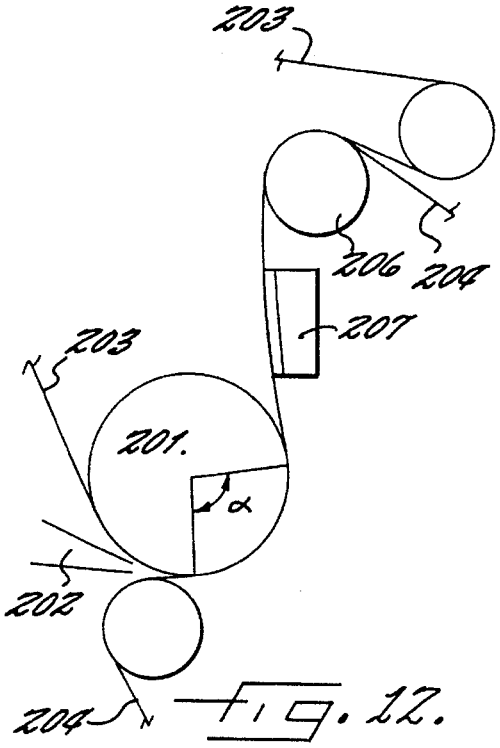
Figure 13:
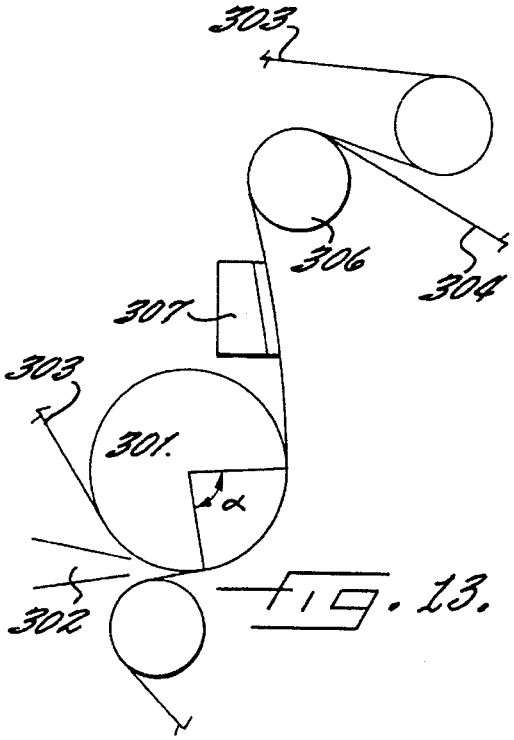

FIGS. 12 and 13 show that the roll type twin wire tissue former to be modified by the installation therein of a multiblade hydrofoil basically does not have to be a C-wrap former but may as well be of a type generally known as an S-wrap former. In an S-wrap former, the forming roll 201 or 301 is located inside a fabric loop, which in the previous embodiments was formed by the outer forming fabric 3 but now constitutes the inner forming fabric 203 and 303, respectively, and the second roll 206 or 306 will then be located inside the loop, which in the previous embodiments was formed by the inner forming fabric 4 but now constitutes the outer forming fabric 204 and 304, respectively. As illustrated in FIGS. 12 and 13, the multiblade hydrofoil 207 and 307, respectively, is placed downstream of the forming roll but upstream of the second roll, and inside either the outer fabric loop as shown in FIG. 12 or the inner fabric loop as shown in FIG. 13.

Figure 14:
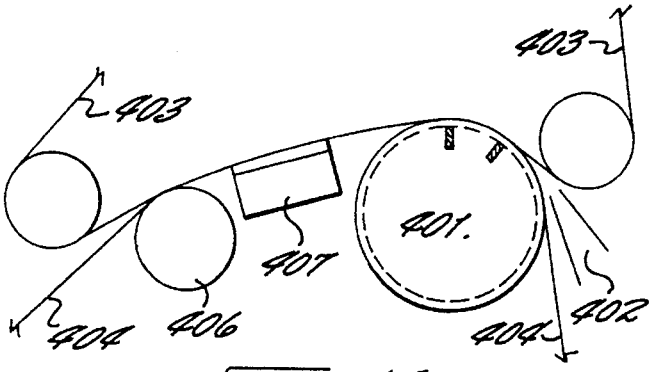

FIG. 14 illustrates an embodiment, in which the roll type twin wire former shown in FIG. 11 and having a substantially vertical forming zone is modified by rotating substantially the entire configuration on the order of 90° so as to make the forming zone substantially horizontal and the outer forming fabric 403 a top fabric. The multiblade hydrofoil 407 is placed inside the loop of the inner or bottom forming fabric 403 and between the forming roll 401 and the second roll 406.

That which is claimed is:

1. A method of forming a tissue paper web in a twin wire former having a rotatable forming roll, said method comprising the steps of:

a) injecting a jet consisting essentially of an aqueous slurry of papermaking fibers into a converging forming throat formed between two looped forming fabrics as they first converge to meet on a periphery of the rotatable forming roll and then partially wrap the forming roll periphery;

b) sandwiching the aqueous slurry between the two forming fabrics and draining a first portion of the drainable water from the slurry through at least one of the forming fabrics while in a first zone wherein the fabrics partially wrap the forming roll periphery up to a point where the fabrics run off from the forming roll periphery;

c) draining a second portion of the drainable water while the forming fabrics are in a second zone downstream of the first zone so as to cause the papermaking fibers to form a fibrous web;

d) running the two forming fabrics with the papermaking fibers sandwiched between them up to and around a section of a second roll; and e) separating one of the two forming fabrics from the formed fibrous web and the other forming fabric no earlier than on said second roll, whereafter the fibrous web is dried to form a tissue paper web;

f) wherein said step b) of draining a first portion of the drainable water from the slurry while in a first zone comprises draining most of the drainable water and leaving a sufficient proportion of drainable water to have papermaking fibers free to move in the slurry during an initial phase of step c); and g) wherein said draining step c) comprises draining the second portion of drainable water from the slurry while vibrating the slurry in the second zone sufficiently to create a micro-turbulence causing a small scale agitation of the fibers to prevent them from forming any appreciable fibrous web until the water remaining in the slurry is insufficient for allowing the fibers to change their position relative to one another.

2. A method as claimed in claim 1, wherein the step of vibrating the slurry is carried out at a frequency of at least 100 Hz.

3. A method as claimed in claim 2, comprising providing at a location downstream of the forming roll but upstream of the second roll a multiblade hydrofoil having at least four foil blades of equal size disposed on a center to center spacing on the order of 50 to 330 millimeters for contacting a contiguous one of the forming fabrics and defining a substantially convexly curved surface supporting said one forming fabric, and wherein said step of vibrating the slurry is carried out by directing one of the forming fabrics across said foil blades.

4. A method as claimed in claim 2, comprising providing at a location downstream of the forming roll but upstream of the second roll a multiblade hydrofoil having a plurality of equidistantly spaced foil blades of equal size for contacting a contiguous one of the forming fabrics and defining a substantially convexly curved surface supporting said one forming fabric, and wherein said step of vibrating the slurry is carried out by directing one of the forming fabrics across said foil blades.

5. A method as claimed in claim 4, wherein said step of providing a hydrofoil comprises disposing the multiblade hydrofoil within the loop of the forming fabric that constitutes an outer forming fabric relative to the forming roll and the other forming fabric in the twin wire former, while the second roll being disposed within the loop of the inner forming fabric.

6. A method as claimed in claim 5, further comprising:

providing as forming roll a suction forming roll; and draining the slurry in step f) through both of the forming fabrics.

7. A method as claimed in claim 6, further comprising running the outer forming fabric over the suction forming roll so as to provide a wrap angle of the outer forming fabric on the suction forming roll on the order of 15° to 45°.

8. A method as claimed in claim 4, further comprising setting the sheet at the passage of the sandwiched papermaking fibers past the multiblade hydrofoil.

9. A method of forming a tissue paper web in a twin wire former having a rotatable forming roll, said method comprising the steps of:

a) injecting a jet consisting essentially of an aqueous slurry of papermaking fibers into a converging forming throat formed between two looped forming fabrics as they first converge to meet on a periphery of the rotatable forming roll and then partially wrap the forming roll periphery;

b) sandwiching the aqueous slurry between the two forming fabrics and draining a first portion of the drainable water from the slurry through at least one of the forming fabrics while in a first zone wherein the fabrics partially wrap the forming roll periphery up to a point where the fabrics run off from the forming roll periphery;

c) draining a second portion of the drainable water while the forming fabrics are in a second zone downstream of the first zone so as to cause the papermaking fibers to form a fibrous web;

d) running the two forming fabrics with the papermaking fibers sandwiched between them up to and around a section of a second roll; and e) separating one of the two forming fabrics from the formed fibrous web and the other forming fabric no earlier than on said second roll;

f) wherein said step b) of draining a first portion of the drainable water from the slurry while in a first zone comprises leaving a sufficient proportion of drainable water to have papermaking fibers free to move in the slurry during an initial phase of step c);

g) wherein said draining step c) comprises draining the second portion of drainable water from the slurry while vibrating the slurry in the second zone sufficiently to create a micro-turbulence causing a small scale agitation of the fibers to prevent them from forming any appreciable fibrous web until the water remaining in the slurry is insufficient for allowing the fibers to change their position relative to one another;

h) step b) further comprising draining in said first zone from about 90% to about 99% of the drainable water from the slurry.

10. A method as claimed in claim 9, further comprising draining in said first zone from about 98% to about 99% of the drainable water from the slurry.

11. A method of forming a tissue paper web in a twin wire former having a rotatable forming roll, said method comprising the steps of:

a) injecting a jet consisting essentially of an aqueous slurry of papermaking fibers into a converging forming throat formed between two looped forming fabrics as they first converge to meet on a periphery of the rotatable forming roll and then partially wrap the forming roll periphery;

b) sandwiching the aqueous slurry between the two forming fabrics and draining a first portion of the drainable water from the slurry through at least one of the forming fabrics while in a first zone wherein the fabrics partially wrap the forming roll periphery up to a point where the two forming fabrics run off from the forming roll periphery;

c) draining a second portion of the drainable water while the forming fabrics are in a second zone downstream of the first zone so as to cause the papermaking fibers to form a fibrous web;

d) running the two forming fabrics with the papermaking fibers sandwiched between them up to and around a section of a second roll; and e) separating one of the two forming fabrics from the formed fibrous web and the other forming fabric no earlier than on said second roll;

f) wherein said draining step b) of draining a first portion of the drainable water from the slurry while in a first zone comprises leaving a sufficient proportion of drainable water to have papermaking fibers free to move in the slurry during an initial phase of step g) wherein said draining step c) comprises draining the second portion of drainable water from the slurry while vibrating the slurry in the second zone sufficiently to create a micro-turbulence causing a small scale agitation of the fibers to prevent them from forming any appreciable fibrous web until the water remaining in the slurry is insufficient for allowing the fibers to change their position relative to one another;

h) providing a headbox for discharging the slurry into the forming throat;

i) providing a breast roll for the outer forming fabric immediately upstream of the forming throat; and j) swinging the headbox and the breast roll as one assembly around a rotational axis of the forming roll to adjust the degree of wrap of the outer forming fabric on the forming roll, and thereby also the proportion of drainable water drained from the slurry at the forming roll.

* * * * *

UNITED STATES PATENT AND TRADEMARK OFFICE
CERTIFICATE OF CORRECTION

PATENT NO. : 5,578,170

DATED : November 26, 1996

INVENTOR(S) : Erikson, et al.

It is certified that error appears in the above-identified patent and that said Letters Patent is hereby corrected as shown below:

Col. 1, line 52, "HS" should be --HHS--.

Col. 1, line 63, "AND" should be --&--.

Col. 6, line 29, "1B" should be --15--.

Col. 11, line 36, "respectively." should be --respectively,--.

Col. 14, line 42, after "step" insert --c);--

Signed and Sealed this

First Day of April, 1997

*Attest:*

*Attesting Officer*

Bruce Lehman

BRUCE LEHMAN

*Commissioner of Patents and Trademarks*